United States Patent [19]

Sperti et al.

[11] 4,265,926

[45] May 5, 1981

[54] METHOD OF TREATING GELATIN CAPSULES AND PRODUCT RESULTING THEREFROM

[76] Inventors: George S. Sperti, 1842 Madison Rd., Cincinnati, Ohio 45206; Norbert J. Berberick, Jr., 2550 Idlewild Rd., Burlington, Ky. 41005

[21] Appl. No.: 876,711

[22] Filed: Feb. 10, 1978

Related U.S. Application Data

[63] Continuation of Ser. No. 788,276, Apr. 18, 1977, abandoned, which is a continuation of Ser. No. 697,570, Jun. 18, 1976, Pat. No. 4,027,671, which is a continuation of Ser. No. 605,523, Aug. 18, 1975, abandoned, which is a continuation of Ser. No. 511,947, Oct. 4, 1974, abandoned, which is a continuation of Ser. No. 341,261, Mar. 14, 1973, abandoned, which is a continuation of Ser. No. 82,742, Oct. 21, 1970, abandoned.

[51] Int. Cl.[3] ..... A61J 3/07

[52] U.S. Cl. ..... 427/2; 264/343

[58] Field of Search ..... 427/236, 2; 222/236, 222/215, 107; 128/232, 272; 264/343

[56] References Cited

U.S. PATENT DOCUMENTS

| | | | |
|---|---|---|---|
| 1,756,010 | 4/1930 | Boughton | 427/236 |
| 2,437,542 | 3/1948 | Krippendorf | 427/2 |
| 2,690,181 | 9/1954 | Boyer | 128/232 |
| 2,802,605 | 8/1957 | Parker | 222/215 |
| 3,063,601 | 11/1962 | Hertz | 222/215 |
| 3,303,847 | 2/1967 | Eaton | 222/215 |

*Primary Examiner*—Sam Silverberg

*Attorney, Agent, or Firm*—Kinney and Schenk

[57] ABSTRACT

A method for treating gelatin capsules so that the end product resulting therefrom may be insertable through a body orifice for application of a measured dose of medicinal material to an area to be treated is disclosed. The method provides for the relative hardening and softening of respective portions of the capsule so as to allow the capsule to perform the desired function. Means are provided with the capsule to permit rupturing of the end of the capsule to allow the medicinal material to be discharged therefrom upon the application of pressure at the other end of the capsule.

10 Claims, 8 Drawing Figures

METHOD OF TREATING GELATIN CAPSULES AND PRODUCT RESULTING THEREFROM

This is a continuation of application Ser. No. 788,276, filed Apr. 18, 1977 now abandoned; which is a continuation of Ser. No. 697,570, June 18, 1976 U.S. Pat. No. 4,027,671; which is a continuation of 605,523, Aug. 18, 1975, abandoned; which is a continuation of Ser. No. 511,947, Oct. 4, 1974, abandoned; which is a continuation of Ser. No. 341,261, Mar. 14, 1973, abandoned; which is a continuation of Ser. No. 82,742, Oct. 21, 1970, abandoned.

BACKGROUND OF THE INVENTION

This invention relates generally to gelatin capsule medications and more particularly to method of treating gelatin capsules so that the capsule may be used for insertion through body orifices so as to apply medicinal material to areas to be treated.

At the present time, there is no convenient and sanitary method for applying certain medicaments to human and animal bodies. A typical example of such a medicament are suppositories. Suppositories liquefy in response to body temperature and as a result oftentimes become softened prior to insertion through the rectal orifice. In addition, the suppository is objectionable to some people because there is no sanitary way to apply the suppositories. Further, when the receiver of the suppository is a small squirming child, the problems are only compounded. The speed with which suppositories perform their desired function is not great. A suppository in liquid form would be faster acting and more desirable, however, there is no present applicator for applying such liquid medicaments.

Other examples of medicaments which are inserted through body orifices are preparations for the treatment of hemorrhoids, certain preparations used for contraceptive purposes, drugs and the like used for the treatment of internal disorders of the rectum and vaginal areas, etc. Generally, a separate applicator is used in these instances. The medicament is applied to the applicator which is then inserted through the body orifice to the area to be treated. Often a lubricant must be applied to the outside of the applicator. A plunger or the like ejects the medicament from the applicator and the applicator is then removed and must be cleaned for sanitation purposes. At the end of the required treatment, the problem arises of how to dispose of the applicator. It is quite difficult to apply the exact amount of medicament required to the applicator. Hence, the person may be receiving too much or too little of the medicament.

The use of gelatin capsules has become quite popular in recent years. One advantage of gelatin capsules is that a predetermined or measured dose of medicament may be placed in the capsule. The medicament may be either a liquid or a gel-like substance. Such capsules are commercially available from R. P. Scherer Corp. and Parke Davis. To date, however, there has been no way to utilize the gelatin capsules for application of medicaments which must be inserted through body orifices. The gelatin capsules are generally too soft to overcome the resistance of the body orifice. If the capsule is made sufficiently hard so as to overcome the resistance of the body orifice, then the capsule is too hard to be able to squeeze the medicament out of the capsule.

Accordingly, it is an object of this invention to provide a method for treating gelatin capsules to make them usable for insertion through body orifices.

Another object of this invention is to provide a gelatin capsule having a sufficiently hardened portion to be inserted through a body orifice yet having a sufficiently softened portion which may be squeezed to eject the medicament therefrom.

A further object of this invention is to provide a gelatin capsule having means for puncturing the hardened portion of the capsule so that the medicament is exhausted through said punctures.

SUMMARY OF THE INVENTION

This invention provides a method for treating gelatin capsules so that the capsule has a hardened portion and a soft portion. The hardened portion is insertable through a body orifice so that medicament may be exhausted therefrom to an area to be treated upon the application of pressure to the softened portion. Means are provided to puncture the hardened portion of the capsule so that the medicament may exit therefrom.

Other details, uses, and advantages of this invention will become apparent as the following description of the exemplary embodiments thereof presented in the accompanying drawings proceeds.

BRIEF DESCRIPTION OF THE DRAWINGS

The accompanying drawings show present exemplary embodiments of the method of this invention and the product in which.

DESCRIPTION OF ILLUSTRATED EMBODIMENTS

Figure 1:
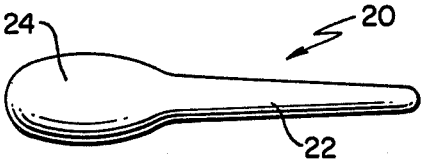
FIG. 1 is a view illustrating a gelatin capsule.

Reference is now made to FIG. 1 of the drawings, which illustrates one exemplary embodiment of a typical gelatin capsule, which is designated generally by the reference numeral 20. The capsule 20 is of a uniform thickness and hardness throughout. It can be seen that the capsule 20 comprises an elongated narrow stem or applicator portion 22 and an enlarged substantially rounded or bulb portion 24. The capsule 20 is formed with the medicament therein. Hence, to remove the medicament, it is necessary to puncture the applicator end 22 and apply pressure to the bulb end 24. The capsule 20 in the present condition, however, is not sufficiently rigid to be inserted through a body orifice. In order to prepare the capsule 20 for such use, the applicator portion 22 must be hardened.

Figure 2:
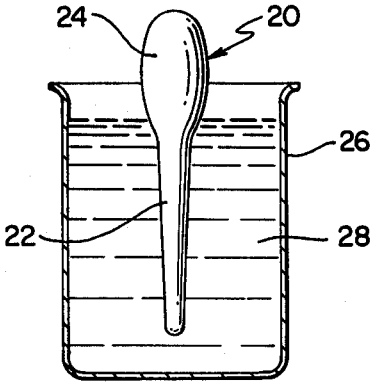
FIG. 2 is a view showing the hardening step.

Referring to FIG. 2, the applicator end 22 and a portion of the bulb end 24 are inserted in a tank or the like 26 containing a hardening agent 28. The agent 28 may be a hard gelatin, epoxy glue such as an epoxy type resin or any agent which will provide a hardening of the elongated portion 22. Any desired degree of hardening may be accomplished through multiple coatings of the hardening agent. After each coat is applied, the coat is allowed to dry. The added thickness of the hardening agent is illustrated in the cutaway portion of FIG. 3 and designated with the number 30.

When the desired hardness of the elongated portion 22 has been obtained, the capsule 20 is inverted and the bulb end 24 is inserted in a container or the like 32 having a softening agent 34 therein. A typical softening agent which has been used is polyvinyl acetate. The capsule 20 is inserted a sufficient amount so that the softening agent reacts with the entire bulb portion plus a short amount of the hardened applicator portion. This will insure that the hardened covering 30 has made a good adhesion and sealing with the gelatin capsule 20.

Figure 4:
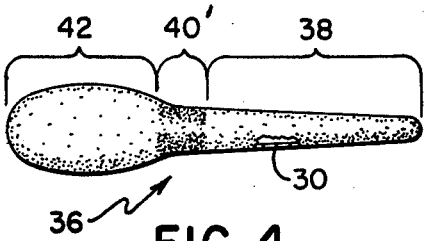
FIG. 4 is a view showing the finished capsule.

The end product is shown in FIG. 4 and designated generally as 36. The capsule 36 has an end portion 38 which has been treated with the hardening agent only and is sufficiently rigid or stiffened to overcome the resistance of a body orifice through which it is to be inserted. That portion of the capsule 36 designated as 40 has been initially hardened and then treated with the softening agent to insure that the hardening coating 30 adheres to the base gelatin capsule with a good seal. The bulb portion 42 has been treated with the softening agent and is sufficiently pliable so that pressure from the fingertips to the bulb portion 42 will cause the medicament to be forced out of an aperture formed in the applicator portion 38.

Figure 3:
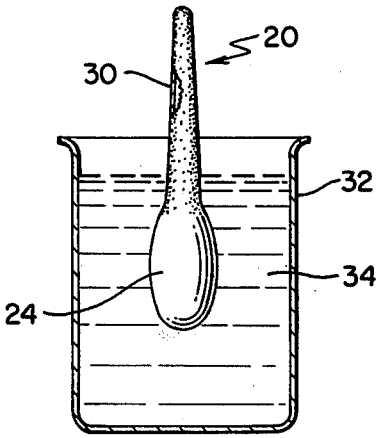
FIG. 3 is a view showing the softening step.

It should be noted that the hardening agent may be applied by other means than dipping or bathing in the agent. As an example, the hardening agent could be sprayed on to provide the desired hardening. In some instances, the gelatin capsule 20 is initially sufficiently hard to overcome resistance by a body orifice. In these cases, the hardening step of FIG. 2 is not needed and only the softening step of FIG. 3 is required.

Figure 5:
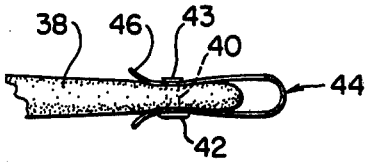
FIG. 5 is a fragmentary view of the elongated end illustrating one means for puncturing the end.

To provide for the puncturing of the hardened end 38, a rivet 40 (FIG. 5) having an enlarged end 42 is inserted through a tab 44. The rivet 40 is then inserted through the end 38 and once again through the tab 44. The end 43 of rivet 40 is slightly upset to prevent the inadvertent removel of the rivet 40 from the applicator end 38. When it is desired to use the capsule 36, the end portion 46 of tab 44 is pulled so as to free end 43 of the rivet 40. The rivet 40 is then removed from the applicator end 38 by pulling on the tab 44.

Figure 6:
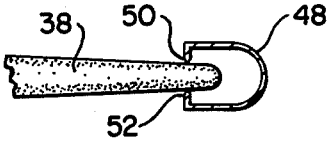
FIG. 6 is a fragmentary view illustrating another means for puncturing the elongated portion.

Another example of a means to puncture the applicator end 38 is shown in FIG. 6 wherein a spring snap 48 having sharp portions 50 and 52 is utilized. The snap 48 is inserted over the end of applicator 38 and an inward pressure is applied on the snap 48 causing points 50 and 52 to puncture the hardened applicator end.

Figure 7:
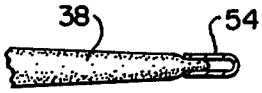
FIG. 7 is a fragmentary view illustrating a further means for forming an exit from the hardened portion.

In the embodiment shown in FIG. 7, a metal tab 54 is substantially flattened over the end of the hardened applicator end 38. The metal tab 54 may be twisted so as to tear off the end of applicator 38. This method is least desirable since the tearing process will very often leave a rough or jagged edge which in most cases is not desirable.

Figure 8:
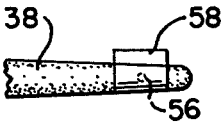
FIG. 8 is a fragmentary view of another means for providing an exit from the hardened end.

In FIG. 8, the applicator end 38 has been prepunctured by any suitable means leaving an aperture 56 therein. Any suitable tape or the like 58 is applied over the aperture 56. The tape or the like 58 may be removed to uncover the aperture 56 when it is desired to use the capsule.

In use, the medicament will also serve as a lubricant. The slight pressure applied on the bulb portion 42 during the insertion of the capsule 36 will cause a small amount of the medicament to exit through the apertures in the applicator end 38. This medicament then, will act as a lubricant. After insertion of the capsule 36, pressure is applied to the bulb portion 42 and the medicament is forced out through the apertures in the end portion 38. The end portion 38 is of a length sufficient to reach the area to be treated so that the medicament is properly placed. Once the capsule has been used, it is then thrown away or may be flushed down a commode for disposal.

While a present exemplary method and exemplary embodiments of this invention have beenn illustrated and described, itt will be recognized that this invention may be otherwise variously embodied and practiced by those skilled in the art.

What is claimed is:

1. A method for treating gelatin capsules having a bulb portion and an elongated portion comprising the step of applying a softening agent tto the bulb portion of the capsule to provide a difference in hardness between the bulb portion and the elongated portion wherein the elongated portion is of sufficient rigidity to be insertable through a body orifice and the bulb portion may be squeezed when the capsule is so inserted whereby a medicament contained therein is forced out the elongated portion.

2. The method according to claim 1 further comprising the step of attaching aperture opening means near the end of the elongated portion.

3. The method according to claim 1 in which the softening agent is polyvinyl acetate.

4. The method according to claim 1 further comprising the step of applying a hardening agent to the elongated portion and a part of the bulb end before the softening agent is applied wherein the elongated portion is hardened to a desired rigidity.

5. The method according to claim 4 in which the hardening agent provides a coating layer over the elongated portion.

6. The method according to claim 5 in which the hardening agent is sprayed on the elongated portion.

7. The method according to claim 5 in which the hardening agent is applied by immersing the elongated portion in the agent.

8. The method according to claim 4 further comprising the step of attaching aperture opening means to the hardened elongated portion near the end thereof.

9. The method of treating gelatin capsules having a bulb portion and elongated portion comprising the steps of coating the elongated portion and a part of the bulb portion with a hardening agent until a desired degree of ridigity is obtained; and applying a softening agent to the bulb portion and a part of the coating on the elongated portion.

10. The method according to claim 9 further comprising the step of attaching aperture opening means near the end of the elongated portion.

* * * * *